US008908889B2

(12) United States Patent
Lautzenhiser et al.

(10) Patent No.: US 8,908,889 B2
(45) Date of Patent: Dec. 9, 2014

(54) TEMPERATURE COMPENSATED PIEZOELECTRIC BUZZER

(71) Applicant: Piezotech, LLC, Indianapolis, IN (US)

(72) Inventors: Frans Lautzenhiser, Zionsville, IN (US); Fredric Bernard Grossman, Fishers, IN (US); Michael H. Phillips, Indianapolis, IN (US); Ramesh Janardhanam, Pardeeville, WI (US)

(73) Assignee: Piezotech, LLC, Indianapolis, IN (US)

( * ) Notice: Subject to any disclaimer, the term of this patent is extended or adjusted under 35 U.S.C. 154(b) by 101 days.

(21) Appl. No.: 13/894,470

(22) Filed: May 15, 2013

(65) Prior Publication Data

US 2013/0279722 A1 Oct. 24, 2013

Related U.S. Application Data

(63) Continuation of application No. PCT/US2011/060624, filed on Nov. 14, 2011.

(60) Provisional application No. 61/413,613, filed on Nov. 15, 2010.

(51) Int. Cl.

| | |
|---|---|
| ***H04R 25/00*** | (2006.01) |
| ***H04R 17/00*** | (2006.01) |
| ***G08B 3/10*** | (2006.01) |
| ***G08B 29/24*** | (2006.01) |
| *G08B 21/04* | (2006.01) |

(52) U.S. Cl.

CPC *H04R 17/00* (2013.01); *G08B 3/10* (2013.01); *G08B 29/24* (2013.01); *G08B 21/043* (2013.01); *G08B 21/0446* (2013.01)

USPC ..... 381/190; 381/315

(58) Field of Classification Search

CPC .. G08B 21/043; G08B 21/0446; G08B 29/24; G08B 3/10; H04R 17/00

USPC ..... 381/190; 340/573.1, 584, 586, 340; 310/338

See application file for complete search history.

(56) References Cited

U.S. PATENT DOCUMENTS

| | | | | |
|---|---|---|---|---|
| 4,541,731 | A | 9/1985 | Bell et al. | |
| 5,317,305 | A * | 5/1994 | Campman | 340/573.1 |
| 5,635,909 | A * | 6/1997 | Cole | 340/586 |
| 5,973,602 | A * | 10/1999 | Cole et al. | 340/584 |
| 6,131,256 | A | 10/2000 | Dydyk et al. | |
| 2007/0247028 | A1 | 10/2007 | Brosch et al. | |

OTHER PUBLICATIONS

Petkus, V. et al., "Temperature Dependence of a Piezoceramic Transducer Electric Impedance," ULTRAGARSAS, 2005, vol. 56, No. 3, pp. 22-25, ISSN 1392-2114.

* cited by examiner

*Primary Examiner* — Davetta W Goins
*Assistant Examiner* — Phylesha Dabney
(74) *Attorney, Agent, or Firm* — Woodard, Emhardt, Moriarty, McNett & Henry LLP

(57) ABSTRACT

A buzzer includes a piezoelectric diaphragm and a housing enclosing the diaphragm and defining a resonating chamber. The chamber includes a sound port and has an optimal resonating frequency $f_{Ht}$ at a temperature T defined by $f_{Ht}=(v_t/2\pi)(\sqrt{(A/v_oL)})$ were $v_t$ is the velocity of sound waves in air at a temperature T, A is the effective area of the sound port, $v_o$ is the volume of the resonating chamber, and L is the effective length of the sound port. A temperature compensating member moves in response to changes in temperature to change the value of $\sqrt{(A/voL)}$ at a rate and in a manner that balances the change in $1/v_t$ across that same temperature range, thereby reducing changes in the product $(v_t/2\pi)(\sqrt{(A/v_oL)})$ and consequently reducing any changes that would otherwise occur in $f_{Ht}$ across that temperature range, thereby holding the value of $f_H$ substantially constant across the temperature range.

11 Claims, 9 Drawing Sheets

TEMPERATURE COMPENSATED PIEZOELECTRIC BUZZER

CROSS-REFERENCE TO RELATED APPLICATIONS

This application is a continuation of International Application No. PCT/US2011/060624, filed Nov. 14, 2011, which claims the benefit of U.S. Provisional Patent Application Ser. No. 61/413,613, filed Nov. 15, 2010, the entire contents of which are hereby incorporated herein by reference.

BACKGROUND

Piezoelectric buzzers may be used to provide audible alerts in personal alert safety systems. Such buzzers typically use a small, thin sheet of material that can be vibrated by a piezoelectric material powered by an electric current to produce a loud buzzing sound. These buzzers are used, for example, by firefighters who wear the buzzers on their protective gear when entering a fire. When the firefighter is in trouble, such as when the firefighter is knocked to the ground, the buzzer will automatically emit a loud sound enabling others to locate and rescue the firefighter.

In emergency situations however, a firefighter and his equipment may be exposed to temperatures ranging from freezing to more than 250° C. Since the output of the buzzer may vary significantly over that temperature range, high temperature buzzers that are optimized for use at standard room temperatures may have their output significantly reduced in high- or low-temperature situations as the sound chamber is detuned relative to the diaphragm resonance.

A need therefore exists for an improved piezoelectric buzzer that provides a relatively consistent output signal strength over a broad temperature range. The present invention addresses that need.

SUMMARY OF THE INVENTION

In one embodiment of the present invention there is provided a piezoelectric buzzer, comprising:

a) a diaphragm that can be vibrated by a piezoelectric material powered by an electric current to produce a buzzing sound;

b) a housing substantially enclosing said diaphragm, wherein said housing defines a resonating chamber that includes at least one sound emission port that provides a passageway for sound waves emitted by the diaphragm to leave the resonating chamber, wherein said resonating chamber has an optimal resonating frequency $f_{Ht}$ at a temperature T defined by:

$$f_{Ht}=(v_t/2\pi)(\sqrt{(A/v_oL)})$$

where: $v_t$ is the velocity of sound waves in air at a temperature T,

A is the effective area of the sound emission port, $v_o$ is the volume of the resonating chamber, and L is the effective length of the sound emission port; and c) a temperature compensating member that moves in response to a change in temperature across all or part of the temperature range 0° C. to 250° C. to change the value of $\sqrt{(A/v_oL)}$ at a rate and in a manner that at least somewhat balances the change in $1/v_t$ across that same temperature range, thereby reducing changes in the product $(v_t/2\pi)(\sqrt{(A/v_oL)})$ and consequently reducing any changes that would otherwise occur in $f_{Ht}$ across that temperature range. In some embodiments the bimetal temperature compensator moves to reduce the value of $\sqrt{(A/v_oL)}$ at substantially the same rate as the value of 1/v changes, thereby holding the value of $f_H$ substantially constant across said temperature range.

In some embodiments the temperature compensating member is a bimetal strip or disc that moves in response to a change in temperature to change the effective area and/or length of a housing port. In some embodiments the temperature compensating member is a bimetal strip or disc that moves in response to a change in temperature to change the effective volume of the resonating chamber. The temperature compensating member preferably moves in response to temperature changes through the range of about 0° C. to at least about 250° C., with the movement being effective to change the value of $\sqrt{(A/v_oL)}$ at substantially the same rate as the value of $1/v_t$ changes in response to that same temperature change, thereby holding the value of $f_{Ht}$ substantially constant across that temperature range.

REFERENCE TO THE DRAWINGS

FIG. 3A shows a perspective view from above (piezo element shown in phantom), and FIG. 3B shows a perspective view from below.

Figure 5A:
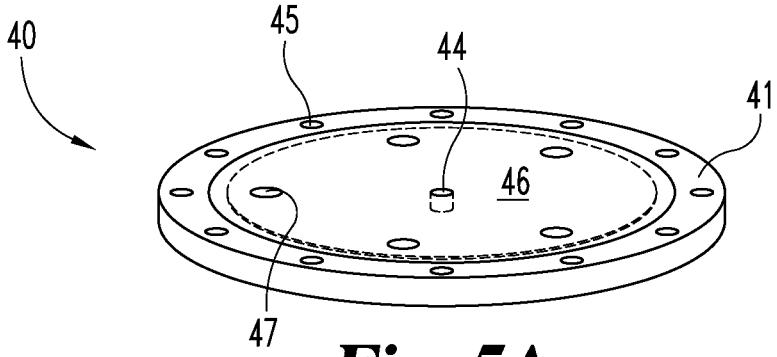
Figure 5B:
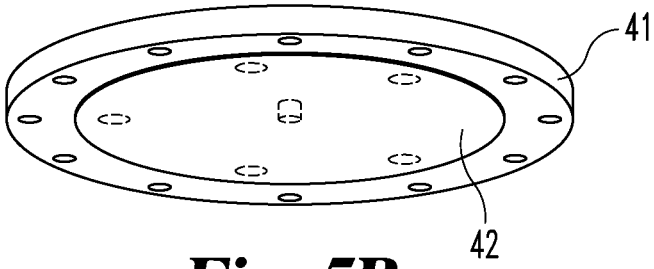
Figure 5C:
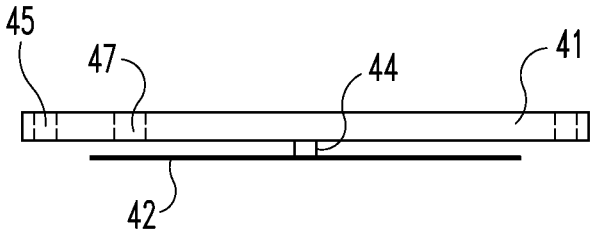
Figure 5D:
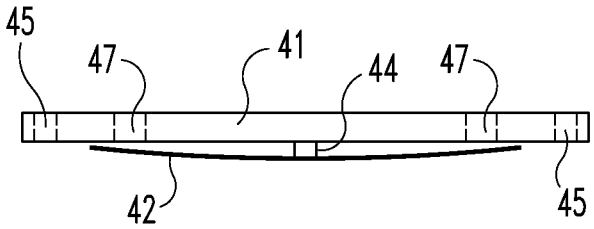

FIGS. 5A-5D are perspective views of the resonance chamber top and associated bi-metal temperature compensating button of the temperature compensated piezoelectric buzzer of the present invention according to one preferred embodiment. FIG. 5A shows a perspective view from above (bi-metal temperature compensating button shown in phantom), and FIG. 5B shows a perspective view from below. FIG. 5C shows a side view illustrating the bi-metal temperature compensating button at a low temperature, and FIG. 5D shows a side view illustrating the bi-metal temperature compensating button at a high temperature.

Figure 6A:
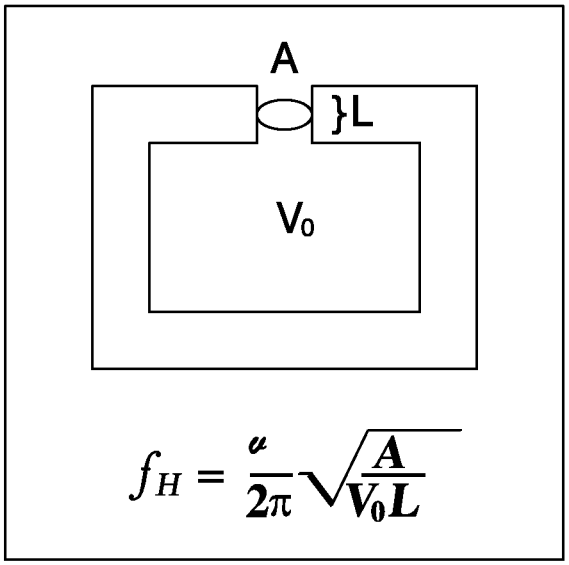

FIG. 6A illustrates a Helmholtz resonator.

Figure 6B:
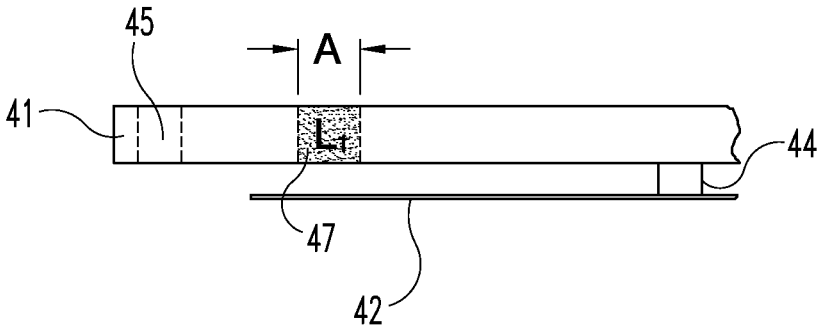
Figure 6C:
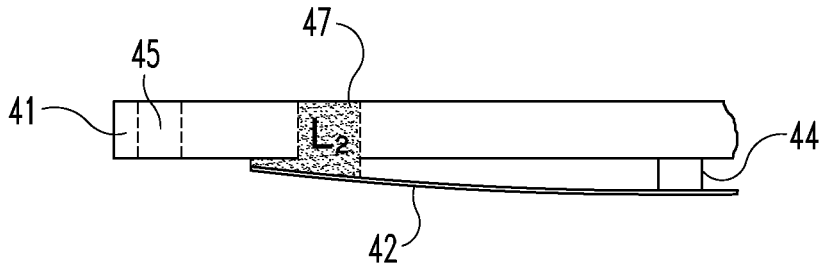

FIGS. 6B and 6C illustrate how the movement of the bi-metal temperature compensating button changes the area, length and/or volume of the sound emission port of the Helmholtz resonator of the present invention.

Figure 7A:
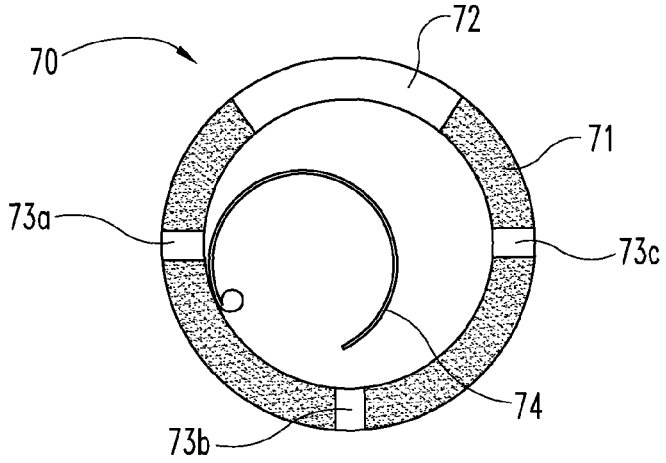
Figure 7B:
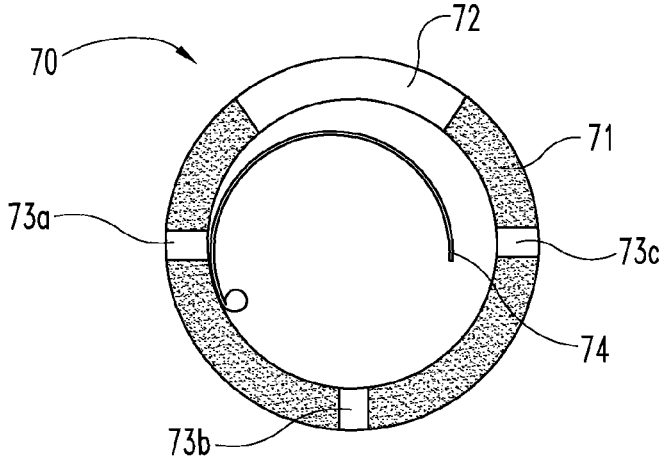
Figure 7C:
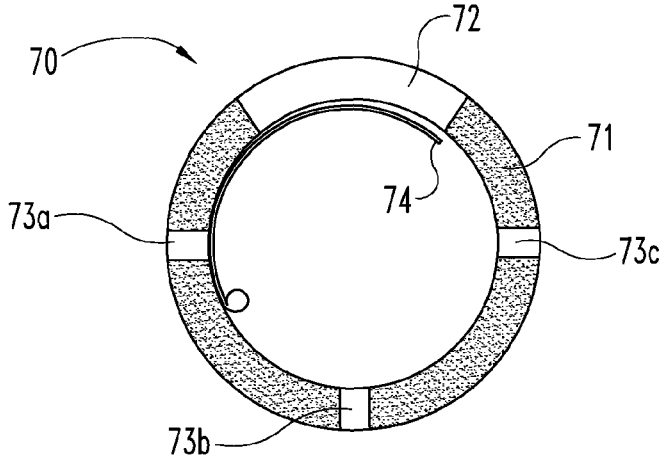

FIGS. 7A-C show a second embodiment of the temperature compensated piezoelectric buzzer of the present invention.

Figure 8:
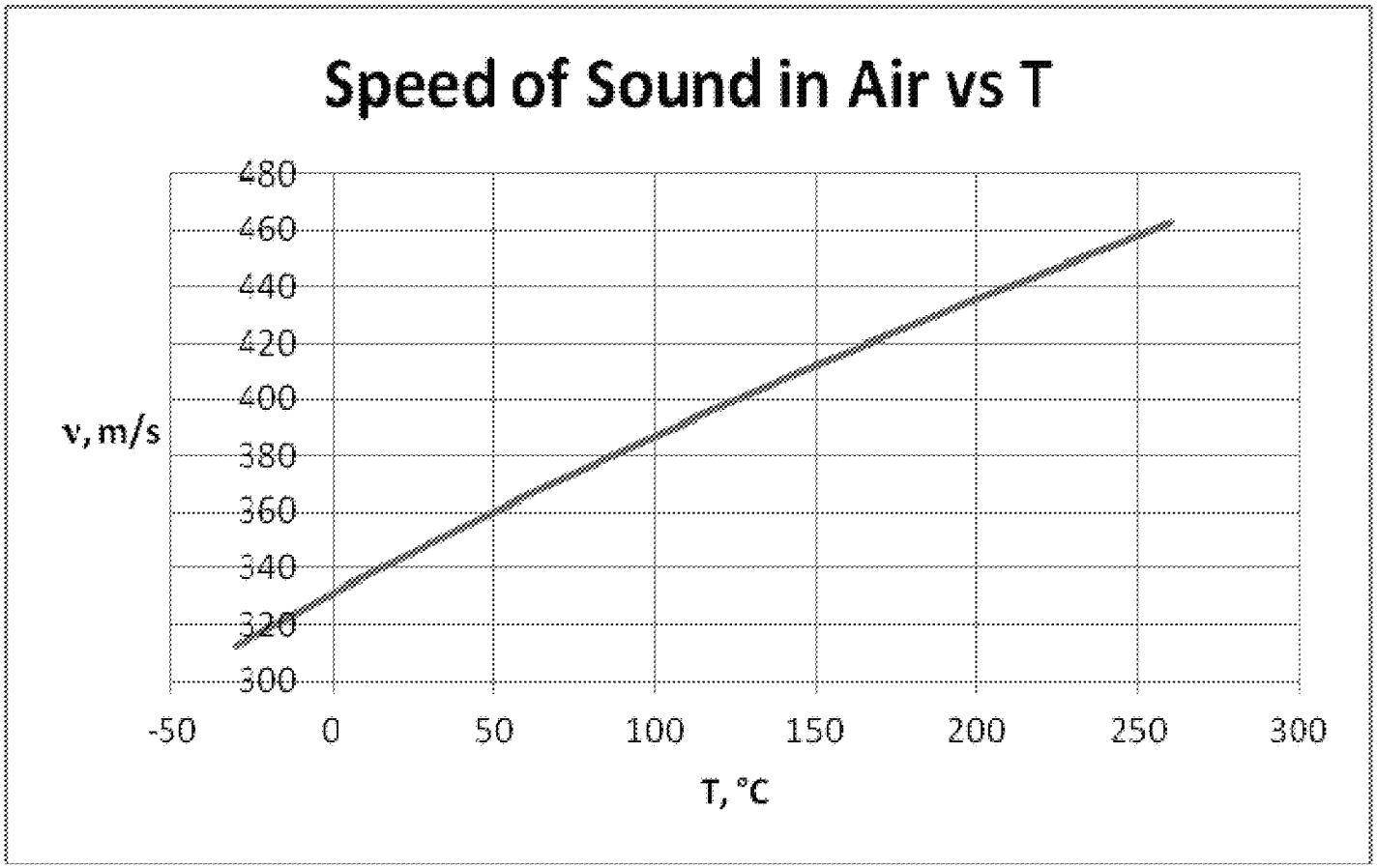

FIG. 8 is a graph depicting the speed of sound in air as temperature.

Figure 9:
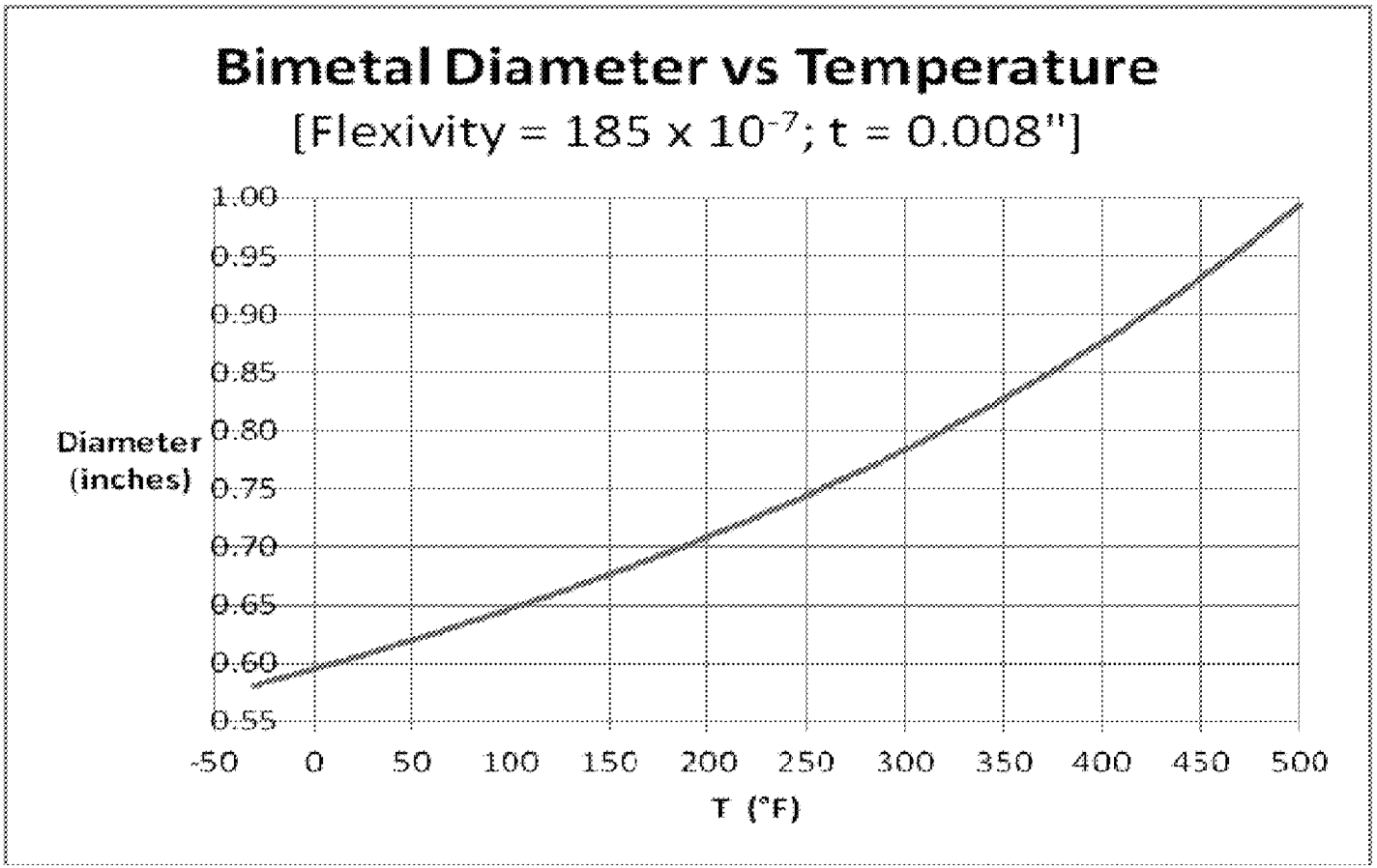

FIG. 9 is a graph depicting bimetal diameter vs. temperature.

Figure 10:
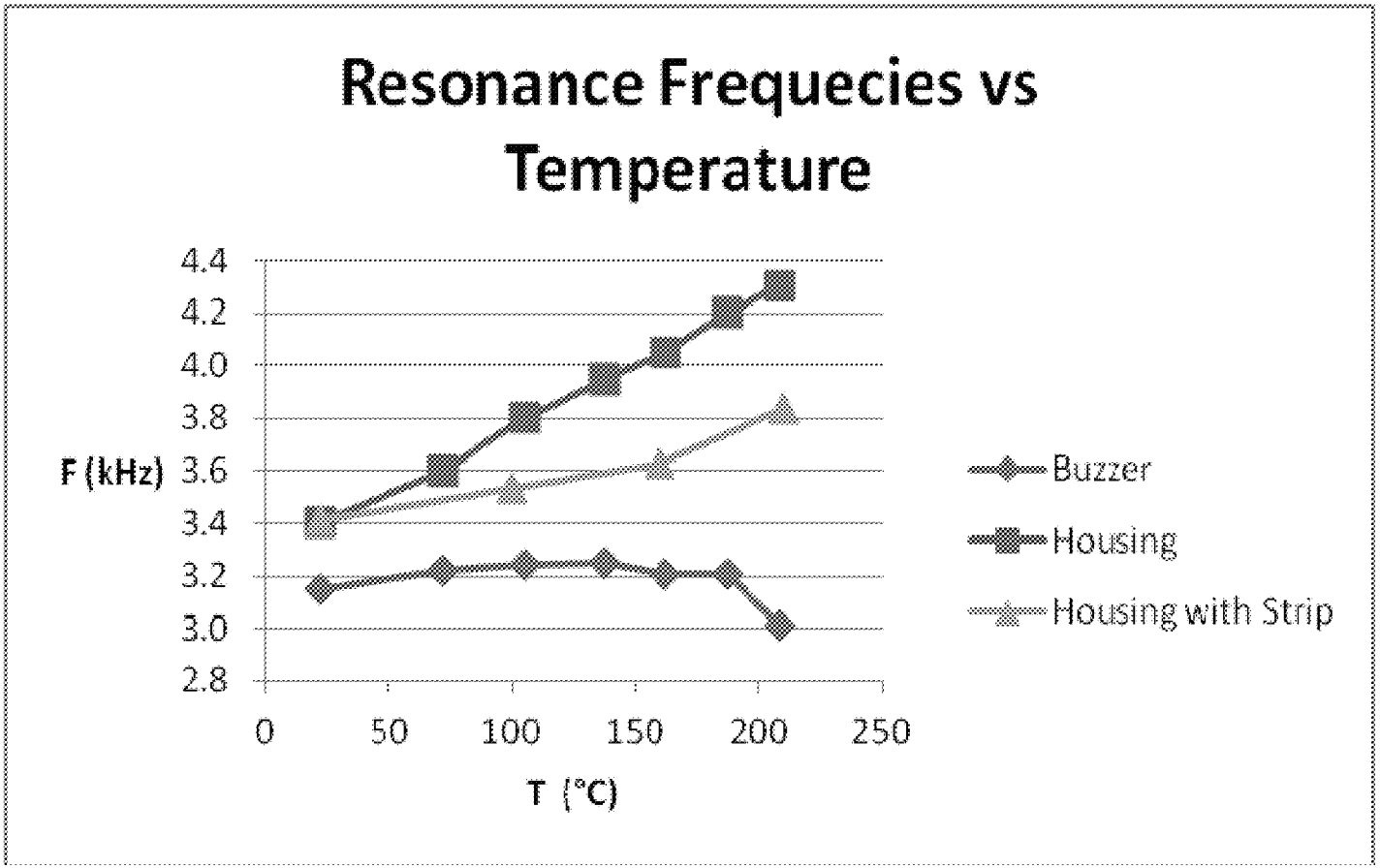

FIG. 10 is a graph depicting resonance frequencies vs. temperature

DESCRIPTION OF THE INVENTION AND ITS PREFERRED EMBODIMENTS

While the present invention may be embodied in many different forms, for the purpose of promoting an understanding of the principles of the present invention, reference will now be made to certain preferred embodiments, and specific language will be used to describe the same. It will nevertheless be understood that no limitation of the scope of the invention is thereby intended. Any alterations and further modifications in the described embodiments, and any further applications of the principles of the present invention as described herein, are contemplated as would normally occur to one skilled in the art to which the invention relates.

As briefly described above, one aspect of the invention provides piezoelectric buzzers that produce a relatively constant sound pressure across a broad range of operating temperatures. In one embodiment the buzzer uses a temperature compensating member, which may be a bimetal material, to adjust the geometry of the resonating chamber and/or the port(s) in the resonating chamber through which sound is emitted, in response to changes in operating temperature so that the buzzer operates more effectively than would otherwise be the case over a broad range of temperatures.

Given a resonating chamber with a volume $v_o$ and a sound emission port with an effective area A and an effective length L, the temperature compensating member moves to alter any one or more of the parameters $v_o$, L, and A to decrease the value of $\sqrt{(A/v_oL)}$ as temperature increases, and to increase the value of $\sqrt{(A/v_oL)}$ as temperature decreases. Most preferably, the value of $\sqrt{(A/v_oL)}$ changes at substantially the same rate, but in the opposite direction, as the velocity of sound in air changes in response to that same temperature change. By holding the value of the product $(v_t/2\pi)(\sqrt{(A/v_oL)})$ substantially constant as the temperature changes, the value of the optimal resonating frequency $f_{Ht}$ remains substantially constant over that same temperature range.

The present invention takes advantage of an understanding that the performance of high temperature buzzers depends on the relationship between the drive frequency, the Helmholtz resonance of the housing and the resonance of the diaphragm structure. Optimal output occurs when the Helmholtz and diaphragm resonances are within about 300 Hz of each other and the drive frequency is somewhere between the two resonances. Although the diaphragm resonance shows relatively little temperature dependence, the Helmholtz resonance is proportional to the speed of sound which is strongly temperature dependent. Accordingly, the optimal relationship between the two resonances only occurs over a limited temperature range.

The Helmholtz resonance frequency is a function of the geometry of the resonating chamber, including the ports through which sound is emitted from the chamber. The present invention therefore addresses the problem of variable temperature by "tuning" the geometry of the resonating chamber to compensate for changes in the operating temperature of the buzzer. In some embodiments the chamber geometry is tuned over a broad range of temperatures by use of a bimetal strip or button. By this technique, the performance of high temperature buzzers may be improved by forming a structure with nearly constant resonance properties across the operational temperature range.

For the purposes of this disclosure a buzzer/sounder can be thought of as including at least two components: a diaphragm and a housing. The diaphragm may comprise a piezoceramic disc bonded to a metal shim (disc) which in turn is swaged or otherwise positioned in the housing. The housing may comprise a structure to hold and protect the diaphragm from below, and a resonating chamber to protect the diaphragm from above and project the sound through one or more sound emission ports. Ports to facilitate emitting sound from the buzzer are preferably included in the resonating chamber.

Figure 1:
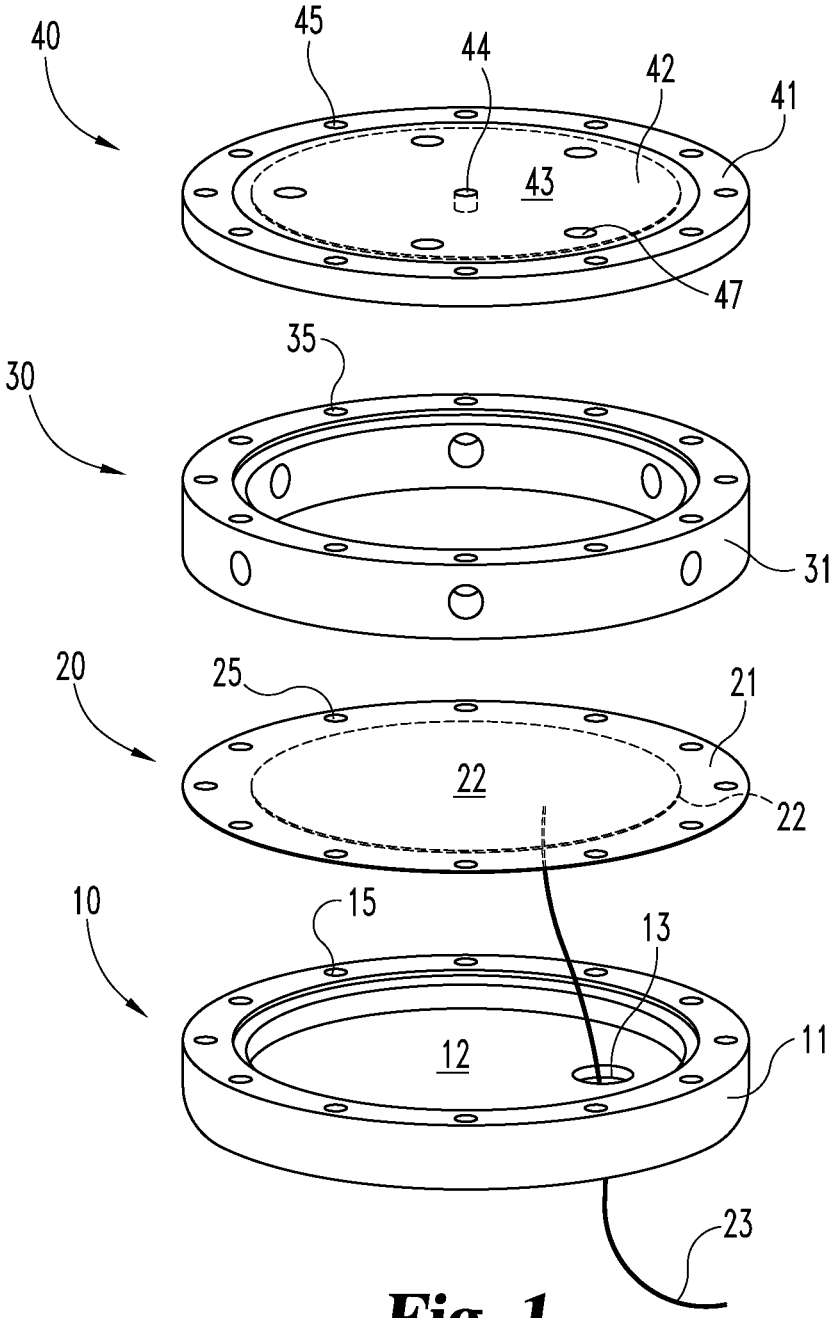
FIG. 1 is an exploded view of the temperature compensated piezoelectric buzzer of the present invention according to one preferred embodiment.

Referring now to the drawings, FIG. 1 shows an exploded view of the temperature compensated piezoelectric buzzer of the present invention according to one preferred embodiment. The main components illustrated in FIG. 1 are housing base 10, piezo element and associated steel sounder disc 20, resonance chamber sidewall 30, and chamber top 40. The temperature compensating member 42 is provided on chamber top 40.

Figure 2:
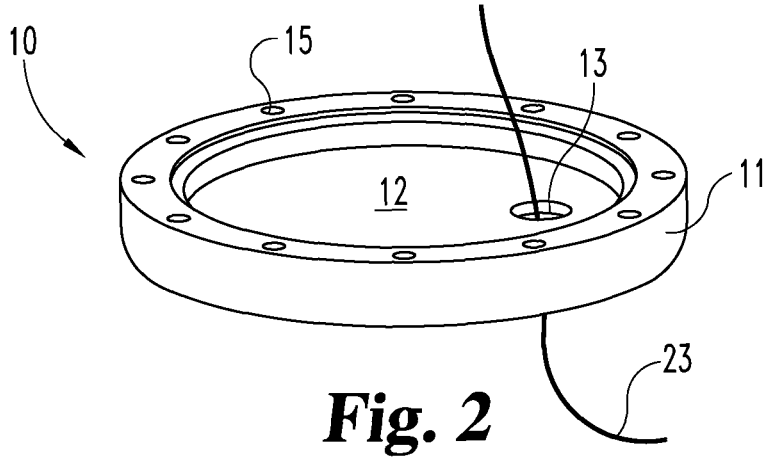
FIG. 2 is a perspective view of the housing base of the temperature compensated piezoelectric buzzer of the present invention according to one preferred embodiment.

As shown more particularly by FIG. 2, housing base 10 includes housing base wall 11 and housing base back 12, with an opening 13 included in the back to allow one or more wires 23 to pass therethrough. A set of tapped holes 15 may be provided to allow other components to be screwed into base wall 11.

Figure 3A:
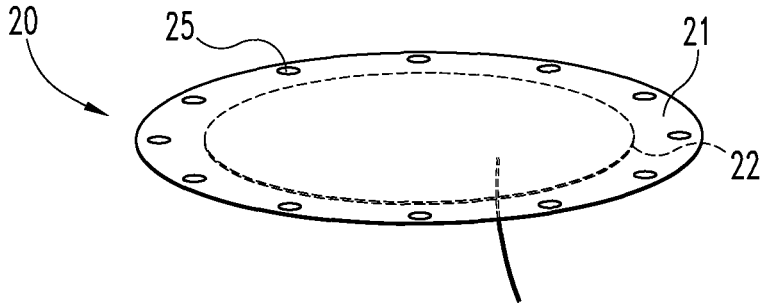
FIGS. 3A and 3B are perspective views of the piezo element and associated steel sounder disc of the temperature compensated piezoelectric buzzer of the present invention according to one preferred embodiment.
Figure 3B:
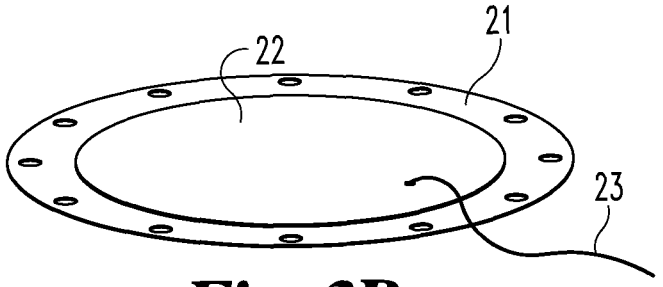

As shown more particularly by FIGS. 3A (top view) and 3B (bottom view), piezo element and associated steel sounder disc 20 includes piezo element 22 adhered to steel sounder disc 21. One or more wires 23 are connected to piezo element 22 to provide power to element 22, and thus to cause element 22 and sounder disc 21 to vibrate and emit sound. A set of holes 25 may be provided to allow element 20 to be screwed into base wall 11. Alternatively the sounder disc may simply be clamped around its perimeter between the housing and the base.

The shim (sounder disc) and housing are used to achieve an effective match between the high impedance of the piezoceramic and the low impedance of air. By placing the piezoceramic on a steel shim the relatively small change in the radius of the ceramic is translated into a much larger up and down motion of the buzzer diaphragm. The housing improves the impedance match by increasing the acoustic pressure on the diaphragm for frequencies near the Helmholtz resonance of the housing.

Figure 4:
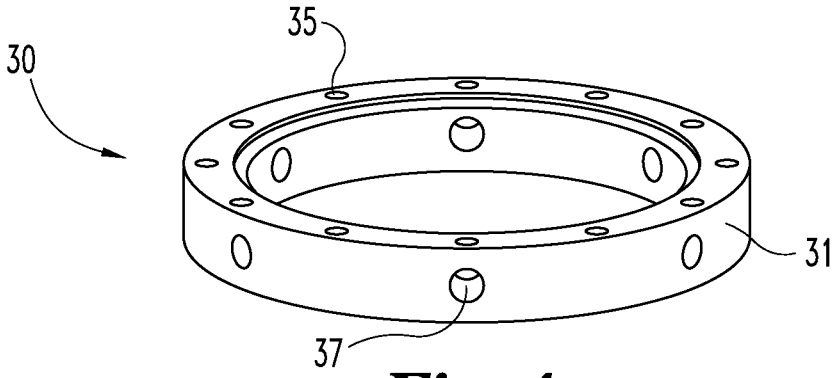
FIG. 4 is a perspective view of the resonance chamber sidewall of the housing of the temperature compensated piezoelectric buzzer of the present invention according to one preferred embodiment.

As shown more particularly by FIG. 4, resonating chamber wall 30 includes wall portion 31. A set of holes 35 may be provided to allow element 30 to be screwed into base wall 11. One or more drain holes 37 may also be provided to allow liquid (typically water) to drain from the device if it gets wet.

As shown more particularly by FIGS. 5A (top view). 5B (bottom view), 5C (side view at low temperature), and 5D (side view at high temperature), chamber top 40 includes top wall 41, top surface 46, and temperature compensating member 42. A post 44 may be used to position the temperature compensating member 42 slightly (typically 1 mm to 5 mm, and preferably 2 mm to 4 mm) below top surface 46. Sound emission ports 47 are included in top surface 46. The sound emission ports are located in the portion of top surface 46 that is "covered" by temperature compensating member 42 when the temperature rises sufficiently to cause member 42 to bend toward top surface 46.

FIG. 6A illustrates a Helmholtz resonator. The resonance frequency $f_H$ of the chamber can be calculated from the volume $V_o$ of the chamber, the length L and the area A of the port, and the velocity of sound. In particular, the optimal resonance frequency $f_H$ is given by the formula:

$$f_{Ht}=(v_t/2\pi)(\sqrt{(A/v_oL)})$$

where: v is the velocity of sound waves in air,

A is the effective area of the sound emission port, $v_o$ is the volume of the resonating chamber, and L is the effective length of the sound emission port.

It is known that the speed of sound in air changes as the temperature of the air changes. The graph in FIG. 8 illustrates the speed of sound in air as temperature changes from about 0° C. to about 250° C.

In view of FIG. 8, the optimal resonance frequency of a Helmholtz resonator at any temperature t can be calculated according to the formula:

$$f_{Ht}=(v_t/2\pi)(\sqrt{(A/v_oL)})$$

where $v_t$ is the velocity of sound waves in air at a temperature t; A is the effective area of the sound emission port; $v_o$ is the volume of the resonating chamber; and L is the effective length of the sound emission port.

In one embodiment of the present invention, the buzzer is constructed as a Helmholtz resonator in which the change in Helmholtz resonance caused by changes in temperature is reduced by modifying the chamber parameters to compensate for changes in the speed of sound. Between about 0° and about 250° C. the velocity of sound increases about 40% (see graph above). Compensating for this requires that at 250° C. the value of √(A/VL) must drop to about one half of its value at 0° C. This result can come through a combination of effects: decreasing the open neck area A, increasing neck length L, or increasing chamber volume V.

FIGS. 6B and 6C illustrate how the piezoelectric buzzer of the present invention is a Helmholtz resonator in which a temperature compensating member moves in response to a temperature change to alter one or more of the parameters $v_o$, L, and/or A to decrease the value of √(A/VL) as temperature increases, and/or to increase the value of √(A/VL), as temperature decreases. By this technique, the value of √(A/VL) may change at substantially the same rate (but in the opposite direction) as the velocity of sound in air changes in response to that same temperature change. By holding the value of the product $(v_t/2\pi)(\sqrt{(A/v_oL)})$ substantially constant as the temperature changes, the value of the optimal resonating frequency $f_{ill}$ remains substantially constant over that same temperature range.

In FIG. 6B, sound port 47 has an effective length $L_1$ (designated by the length of the shaded area) and an effective width $A_1$ (designated by the width of the shaded area). The volume of the resonating chamber is the volume bounded by steel sounder disc 20 below, resonating chamber wall 31 on the sides, and top surface 41 above.

In FIG. 6C, sound port 47 has an effective length $L_2$ (designated by the length of the shaded area) that is longer than effective length $L_1$ by virtue of temperature compensating member 42 bending up to add an additional (longer) "port" section before the uncompensated port structure begins. Sound port 47 also has an effective width $A_2$ (not labeled, but designated by the width of the shaded area) that is slightly smaller than effective area $A_1$ by virtue of temperature compensating member 42 bending up to add an additional, narrower "port" section before the uncompensated port structure begins.

In other embodiments the temperature compensating member may move in response to a temperature change to change the volume $v_o$ of the resonating chamber.

Regardless of whether the temperature compensating member moves in response to a temperature change to change the length L, the area A, or the volume $v_o$ of the resonating chamber, it is desired that the change causes a change in the value of $\sqrt{(A/v_oL)}$ that offsets the change in the product $(v_t/2\pi)(\sqrt{(A/v_oL)})$ that would otherwise occur from a change in $1/v_t$ that occurs from that same temperature change. Thus, the temperature compensating member may cause the value of the optimal resonating frequency $f_{Ht}$ to remain substantially constant over that same temperature range.

It is to be appreciated that the Figures herein illustrate the concepts and certain preferred embodiments of the present invention, and that other structures in which the effective length or width or the sound emission port(s), and/or the effective volume of the resonating chamber, is changed in response to a change in temperature, with the change being sufficient to change the value of √(A/VL) at a rate effective to balance the rate of change of the velocity of sound over that same temperature change, and thus to reduce or offset the change in optimal buzzer resonating frequency that would otherwise occur. For example, FIGS. 7A-7C show a top view of a cross-section of a second embodiment of the inventive piezoelectric buzzer. Buzzer 70 includes wall 71, opening 72 and temperature compensating strip 74. In addition to the main opening (sound port) at the top, several drain holes 73*a-c* are provided to ensure that the buzzer will not trap enough water to silence the buzzer.

In testing to date it has been found that drain holes may have a significant effect on the resonance frequency and output of the device. The size and location of such drain holes must therefore be taken into account when developing a temperature compensation plan. In FIG. 7A, bimetal strip 74 is fixed near port 73*a* and straightens as the temperature increases. The strip is oriented to leave all ports as open as possible at low temperatures but to completely close the main port 72 and port 73*a* at temperatures above about 250° C.

In one embodiment of the present invention, a material referred to as PMC 27-1 by Polymetallurgical and BP1 by Crest Manufacturing is used as the temperature compensating member that moves in response to temperature changes and changes the geometry of the resonance chamber. This material is formed with a layer of Invar and a layer of nickel steel and is recommended for applications requiring good corrosion resistance. The material has a relatively high, constant flexivity and is recommended for the temperature range from −100° to +500° F.

The graph in FIG. 9 shows the calculated response of a BP1 bimetal strip 8 mils thick and shaped to a diameter of 0.63" at room temperature. This response corresponds to the bimetal curve at different temperatures shown in the diagram above. The interior diameter of the illustrated chamber is about 0.98" and the calculated temperature where the bimetal diameter equals the interior diameter is about 490° F.

The graph in FIG. 10 shows the frequency response of an unmodified housing and a housing using a temperature compensating member, which in this case was a bimetal strip. The addition of the temperature compensating member reduces the variation of the frequency with temperature to less than half of what it had been without the strip.

In some embodiments the housing may be tuned by positioning the temperature compensating member in the housing to get a constant resonance at the desired frequency. One starting point for the tuning is the 500° F. point where the main sound emission port(s) are closed. The effective length and/or effective diameter of the ports can then be modified by allowing the temperature compensating member to respond to a change in temperature in a way that gives the desired frequency. Because the resonant frequency is directly proportion to □, the speed of sound, this compensation can actually be done at room temperature by relating the 500° F. response to the room temperature response: $F_{RT}\times\square_{500\circ F.}=F_{500\circ F.}\times\square_{RT}$.

For example if the goal frequency is 3.3 kHz then at room temperature with the temperature compensating member in the 500° F. position the resonance should be around 2.45 kHz.

Similarly the response at −30° F. can be tuned using:

$F_{RT}\times\square_{-30\circ F.}=F_{-30\circ F.}\times\square_{RT}$.

In this case, with a goal frequency of 3.3 kHz and the temperature compensating member in the −30° F. position the resonance frequency should be around 3.69 kHz.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

The invention claimed is:

1. A piezoelectric buzzer, comprising:

a) a diaphragm that can be vibrated by a piezoelectric material powered by an electric current to produce a buzzing sound;

b) a housing substantially enclosing said diaphragm, wherein said housing defines a resonating chamber that includes at least one sound emission port that provides a passageway for sound waves emitted by the diaphragm to leave the resonating chamber, and wherein said resonating chamber has an optimal resonating frequency at a temperature T defined by:

$$f_H = v/2\pi(\sqrt{(A/v_o L)})$$

wherein: v is the velocity of sound waves in air at a temperature T,

A is the effective area of the sound emission port, $v_o$ is the volume of the resonating chamber, and L is the effective length of the sound emission port; and c) a bimetal temperature compensator that moves in response to a change in temperature across a temperature range of at least 200° C. to reduce the value of $\sqrt{(A/v_o L)}$ at substantially the same rate as the value of 1/v changes in response to that same temperature change, and thereby to hold the value of $f_H$ substantially constant across said temperature range.

2. A piezoelectric buzzer according to claim 1 wherein said bimetal temperature compensator moves in response to a change in temperature to change the effective area of a housing port.

3. A piezoelectric buzzer according to claim 1 wherein said bimetal temperature compensator moves in response to a change in temperature to change the effective length of a housing port.

4. A piezoelectric buzzer according to claim 1 wherein said bimetal temperature compensator moves in response to a change in temperature to change the effective volume of the resonating chamber.

5. A piezoelectric buzzer according to claim 1 wherein said bimetal temperature compensator comprises a layer of Invar and a layer of nickel steel differing in composition from the composition of the Invar layer.

6. A piezoelectric buzzer, comprising:

a) a diaphragm that can be vibrated by a piezoelectric material powered by an electric current to produce a buzzing sound;

b) a housing substantially enclosing said diaphragm, wherein said housing defines a resonating chamber that includes at least one sound emission port that provides a passageway for sound waves emitted by the diaphragm to leave the resonating chamber, wherein said resonating chamber has an optimal resonating frequency $f_{Ht}$ at a temperature T defined by:

$$f_{Ht} = (v_t/2\pi)(\sqrt{(A/v_o L)})$$

where: $v_t$ is the velocity of sound waves in air at a temperature T,

A is the effective area of the sound emission port, $v_o$ is the volume of the resonating chamber, and L is the effective length of the sound emission port; and c) a temperature compensating member that moves in response to a change in temperature across all or part of the temperature range 0° C. to 250° C. to change the value $\sqrt{(A/voL)}$ at a rate and in a manner that at least somewhat balances the change in $1/v_t$ across that same temperature range, thereby reducing changes in the product $(v_t/2\pi)(\sqrt{(A/v_o L)})$ and consequently reducing any changes that would otherwise occur in $f_{Ht}$ across that temperature range.

7. The buzzer of claim 6 wherein the temperature compensating member moves to reduce the value of $\sqrt{(A/voL)}$ at substantially the same rate as the value of 1/v changes, thereby holding the value of $f_H$ substantially constant across said temperature range.

8. The buzzer of claim 7 wherein the temperature compensating member is a bimetal strip or disc that moves in response to a change in temperature to change the effective area and/or length of a housing port.

9. The buzzer of claim 7 wherein the temperature compensating member is a bimetal strip or disc that moves in response to a change in temperature to change the effective volume of the resonating chamber.

10. The buzzer of claim 7 wherein the temperature compensating member moves in response to temperature changes through the range of about 0° C. to at least about 250° F.

11. The buzzer of claim 10 wherein the temperature compensating member movement is effective to change the value of $\sqrt{(A/voL)}$ at substantially the same rate as the value of $1/v_t$ changes in response to the same temperature change, thereby holding the value of $f_{Ht}$ substantially constant across that temperature range.

* * * * *